US011432628B2

(12) United States Patent
Fabbri

(10) Patent No.: US 11,432,628 B2
(45) Date of Patent: Sep. 6, 2022

(54) SUITCASE, PREFERABLY OF THE RIGID TYPE, WITH AN INTERCHANGEABLE EXTERNAL CASE

(71) Applicant: Valentina Fabbri, Florence (IT)

(72) Inventor: Valentina Fabbri, Florence (IT)

(73) Assignee: VF Agency Limited, Lymm (GB)

( * ) Notice: Subject to any disclaimer, the term of this patent is extended or adjusted under 35 U.S.C. 154(b) by 691 days.

(21) Appl. No.: 16/063,231

(22) PCT Filed: Sep. 13, 2016

(86) PCT No.: PCT/IB2016/055435
§ 371 (c)(1),
(2) Date: Jun. 15, 2018

(87) PCT Pub. No.: WO2017/103695
PCT Pub. Date: Jun. 22, 2017

(65) Prior Publication Data

US 2020/0268118 A1 Aug. 27, 2020

(30) Foreign Application Priority Data

Dec. 15, 2015 (IT) ..... 102015000083280

(51) Int. Cl.

| | |
|---|---|
| ***A45C 5/03*** | (2006.01) |
| ***A45C 5/02*** | (2006.01) |
| ***A45C 5/14*** | (2006.01) |
| ***A45C 13/04*** | (2006.01) |
| ***A45F 3/04*** | (2006.01) |

(52) U.S. Cl.
CPC ..... *A45C 5/03* (2013.01); *A45C 5/02* (2013.01); *A45C 5/14* (2013.01); *A45C 13/04* (2013.01); *A45F 3/04* (2013.01); *A45C 2005/037* (2013.01)

(58) Field of Classification Search
CPC .. A45F 3/04; A45C 13/04; A45C 5/03; A45C 7/005
USPC ..... 190/124; 150/105
See application file for complete search history.

(56) References Cited

U.S. PATENT DOCUMENTS

| | | | | |
|---|---|---|---|---|
| 4,344,646 A * | 8/1982 | Michel | A45C 13/1084 | 220/326 |
| 4,540,071 A * | 9/1985 | Schaub | A45C 7/005 | 190/121 |
| 4,852,520 A * | 8/1989 | Goetz | A01K 1/0245 | 119/497 |

(Continued)

FOREIGN PATENT DOCUMENTS

| | | |
|---|---|---|
| DE | 4221215 | 1/1994 |
| DE | 102007017834 | 11/2007 |

(Continued)

OTHER PUBLICATIONS

English Translation of DE 102007017834 specification. (Year: 2020).*

*Primary Examiner* — Valentin Neacsu
*Assistant Examiner* — Justin Caudill
(74) *Attorney, Agent, or Firm* — Themis Law

(57) ABSTRACT

A container for the transport of objects, clothing, accessories, and books includes a frame and at least one shell connected to the frame and at least partly delimiting an inner containment volume, wherein the at least one shell is interchangeably connected to the frame.

13 Claims, 12 Drawing Sheets

(56) References Cited

U.S. PATENT DOCUMENTS

| | | | | |
|---|---|---|---|---|
| 5,048,649 | A * | 9/1991 | Carpenter | A45C 13/262 190/18 A |
| 5,529,156 | A * | 6/1996 | Yang | A45C 3/001 190/122 |
| 6,050,373 | A * | 4/2000 | Wonka | A45C 13/26 190/103 |
| 6,070,754 | A | 6/2000 | Newby, Sr. | |
| 6,234,287 | B1 * | 5/2001 | Pfeiffer | A45C 7/005 150/105 |
| 7,240,778 | B2 * | 7/2007 | Duncanson | A45C 13/08 150/105 |
| 9,841,160 | B2 * | 12/2017 | Magras-Sinnen | F21V 1/146 |
| 2008/0227331 | A1 * | 9/2008 | Qiu | H01R 13/73 439/527 |
| 2011/0186398 | A1 * | 8/2011 | Sheikh | A45C 7/0027 190/18 A |
| 2015/0114776 | A1 * | 4/2015 | Mathieu | A45C 5/02 190/127 |

FOREIGN PATENT DOCUMENTS

| | | |
|---|---|---|
| WO | 9112744 | 9/1991 |
| WO | 2006017464 | 2/2006 |

* cited by examiner

SUITCASE, PREFERABLY OF THE RIGID TYPE, WITH AN INTERCHANGEABLE EXTERNAL CASE

TECHNICAL FIELD

The present invention refers to the technical field of the containers in general, for example travel suitcase or backpacks of any form or size.

In particular, the invention refers to a container which is structured in such a manner that results more long-lasting and it can be modified in its colors and/or decorations depending on necessities.

BACKGROUND ART

Travel suitcases have been known for a long time and they have various sizes.

The so-called trolleys suitcases are equipped with casters in order to simplify their transport and have restrained sizes. Their sizes are numerous and usually respect airport regulations. Some said suitcases have small sizes in order to be boarded as hand luggage, while in other cases they have bigger sizes.

Suitcases can be divided into rigid ones or not rigid ones. Rigid suitcases are formed by an external shell which can be opened as a book and closed again and formed by rigid material which can be made of plastic or carbon-fibers or similar materials.

The advantage of a rigid suitcase is that it can preserve better the contents in case of impacts or weights on it, since it maintains basically its original form even when it is squashed by the weight of other suitcases. Always more frequently said suitcases are spreading commercially.

Other types of suitcases may be made of normal textile but they distort themselves more frequently in case of overhead weights.

A technical problem related to rigid suitcases is that they prove to be more fragile than textile suitcases, if they are submitted to strong impacts or weights. Obviously, during travel, for example while squeezing suitcases into the airplane fuselage, suitcases are often stuffed and thrown away with little care. The result is the risk of picking up a damaged, scratched or even broken suitcase upon arrival.

Various solutions have been proposed to this kind of problem.

A solution is described in GB22533781, wherein the application of an external textile upholstery is provided.

This kind of solution, even it proves functional to protect from scratches, results less efficient in case of impacts, as it cannot guarantee an acceptable protection.

In fact, textile cannot guarantee any kind of protection against impacts, voluntary cuts, strikes but only a protection against scraping scratches.

SUMMARY OF THE INVENTION

It is therefore the aim of the present invention to provide a container, for the transport of objects in general such as clothing/accessories/books which solves said technical inconveniences.

In particular, it is the aim of the present invention to provide a container for the transport of objects in general, which results to be efficaciously resistant to impacts, scratches and also changeable depending on tastes and needs.

These and other aims are thus obtained with the present container (1), for the transport of objects/clothing/accessories/books comprising a frame (11, 102) and at least a shell (2, 10, 101), connected to the frame and delimiting at least partly an inner containment volume.

According to the invention, such shell is connected to the frame in interchangeable way.

The rigid container is thus formed by one or more shells made of rigid or semi-rigid material that form the body in its entirety.

According to the invention, the shell forming such body (one or more than one) can be detached from the frame in such a manner that it can be possible to connect a new shell on it, obviously compatible to that kind of frame.

In this manner, all said technical inconveniences are solved easily.

In particular, in case of breaking the shell, if for example the container is subject to an impact, it is possible to change it rapidly to bring back the container, for example a suitcase, to its condition as brand new object.

Furthermore, in this manner, it is possible to change design practically and rapidly if necessary without the necessity of buying numerous different containers.

For example, in case of suitcase, it is possible to buy not only the suitcase but also a set of compatible shells with color, material and also different design. Time after time said shells can be changed by modifying the overall aspect of the suitcase according to personal tastes.

For example, two shells with different colors or shells with different design can be attached to the suitcase, thus making it creative with the color according to the tastes or wishes of the moment.

BRIEF DESCRIPTION OF THE DRAWINGS

Further features and advantages of the present container, according to the invention, will result to be clearer with the description that follows of some embodiments, made to illustrate but not to limit, with reference to the attached drawings, wherein.

Figure 9:
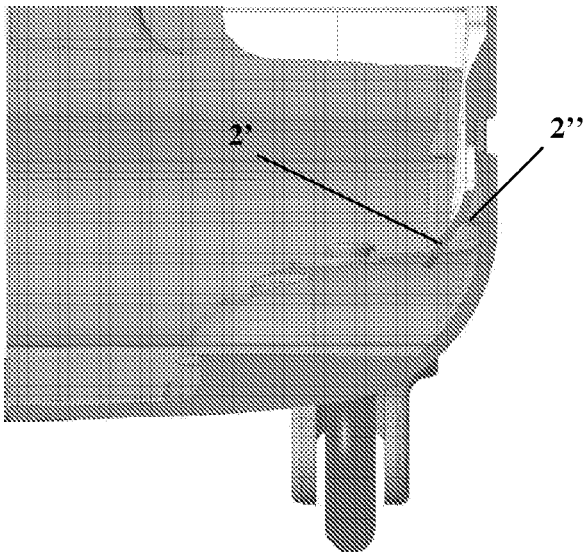
Figure 10:
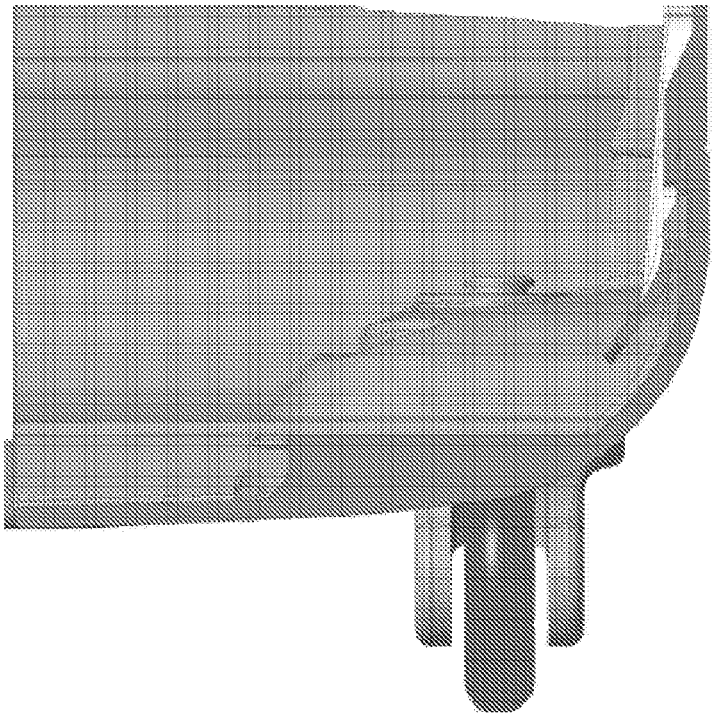
Figure 11:
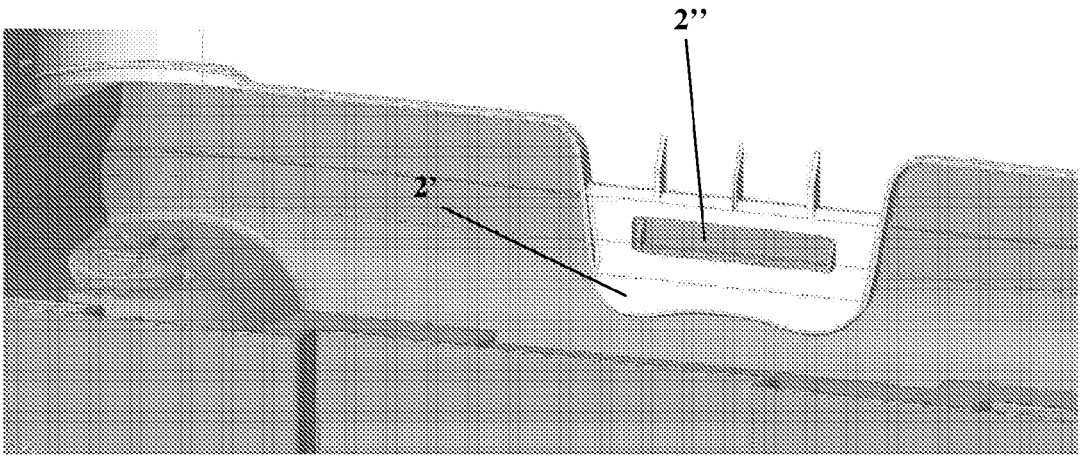
Figure 12:
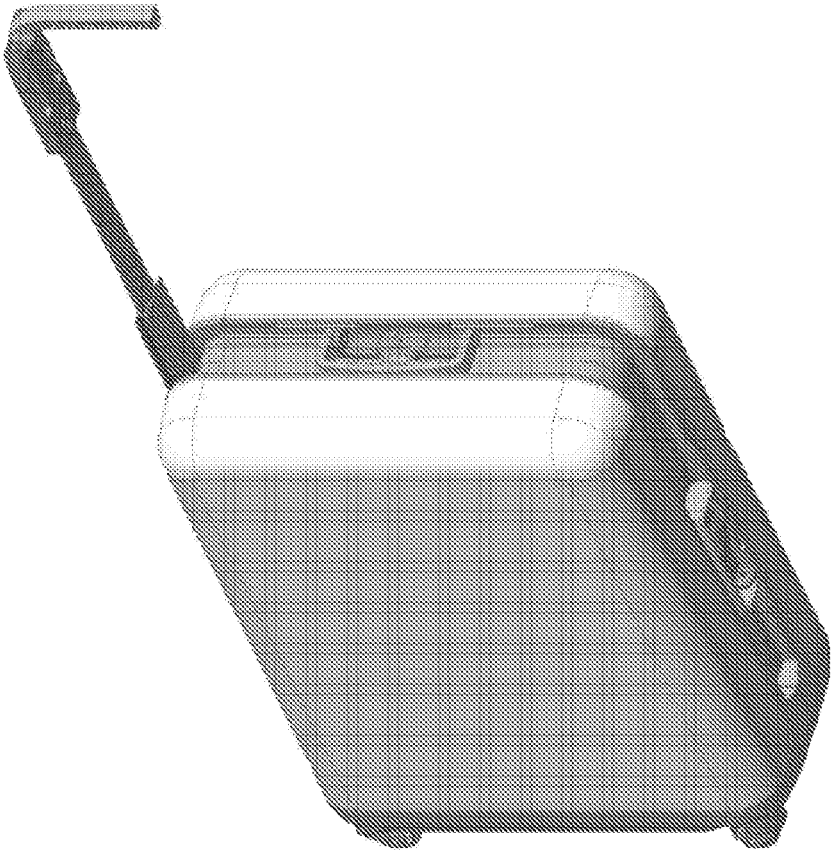
Figure 13:
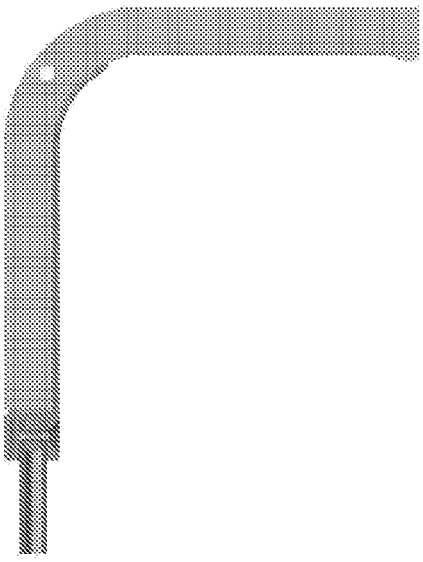
Figure 14:
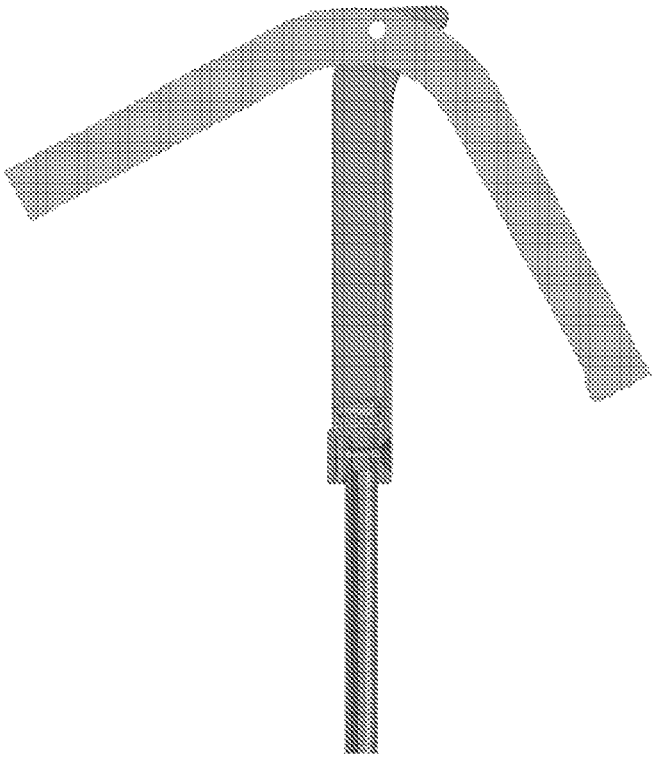
Figure 15:
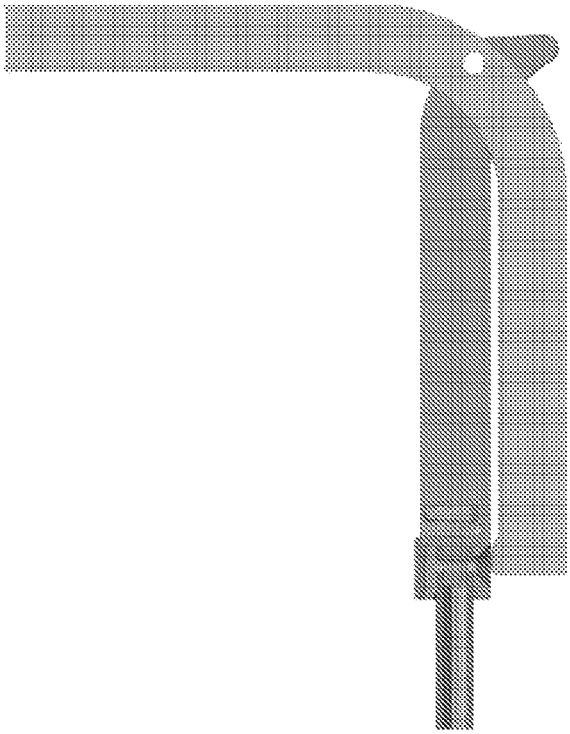
Figure 16:
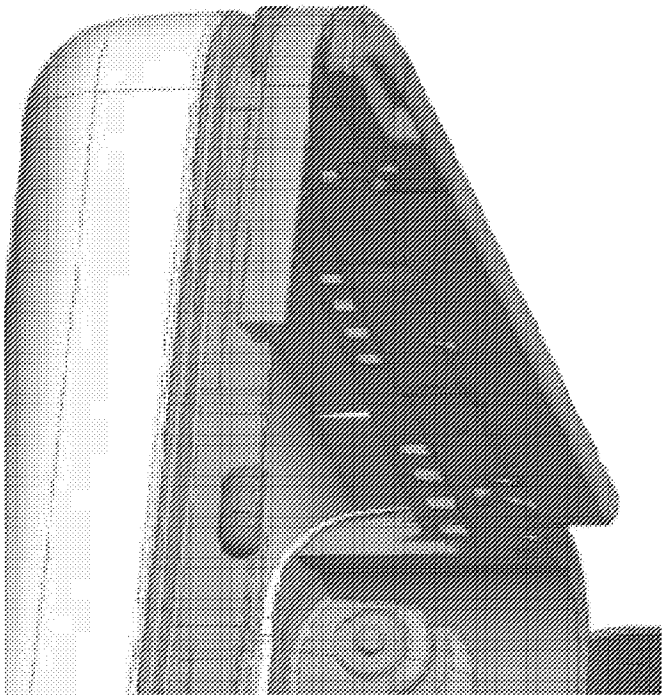
Figure 16A:
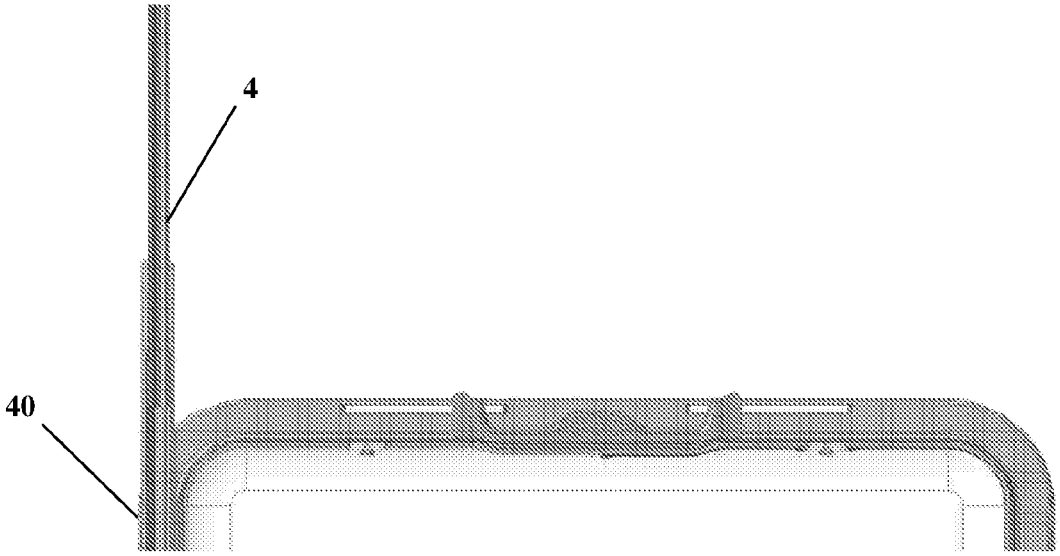
Figure 17:
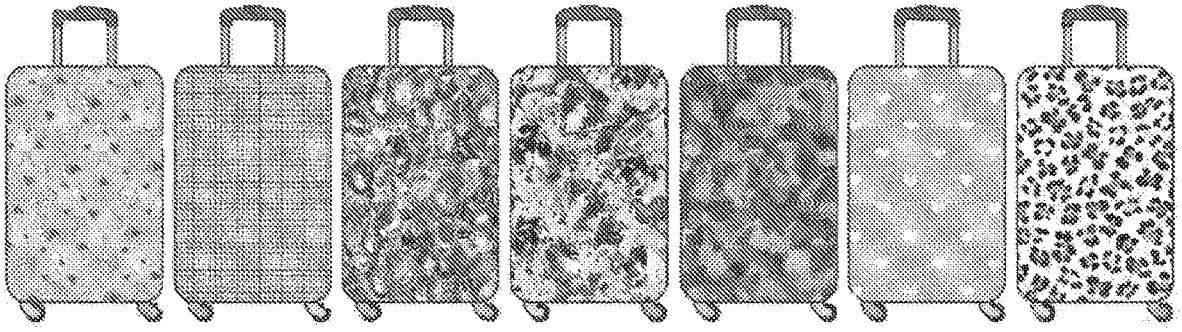
Figure 18:
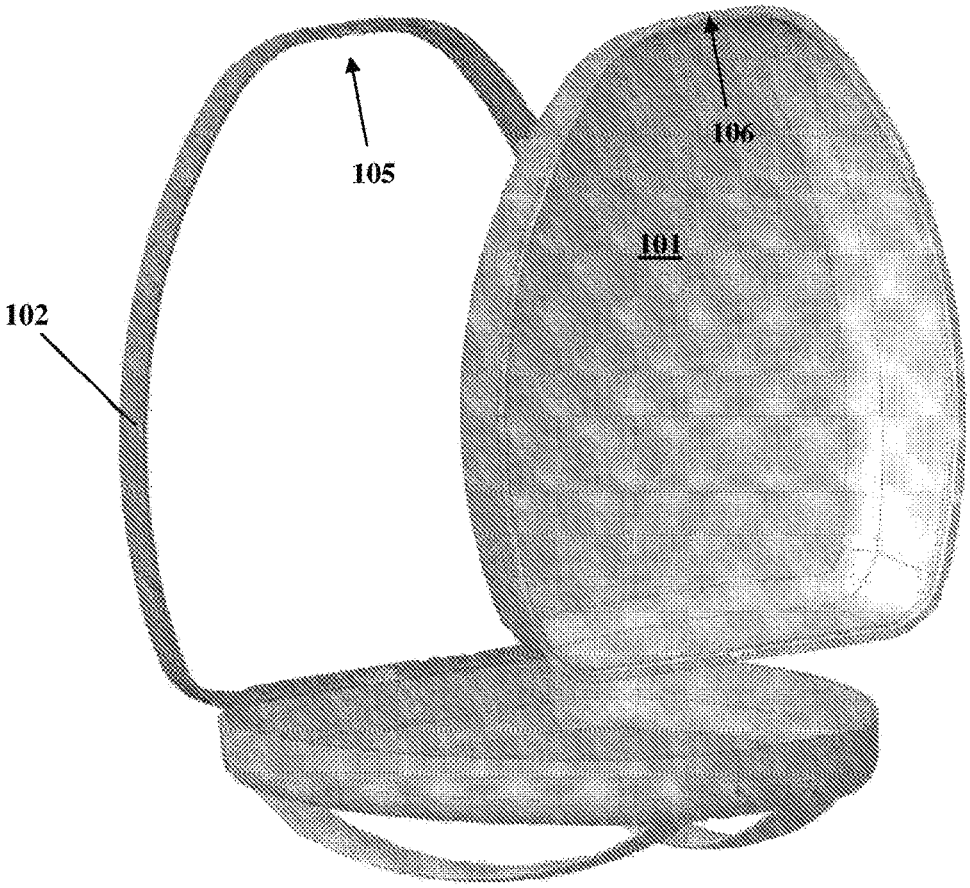

The sections of FIGS. 9 and 10 show the phase of taking the flap which couples with the pivot to fix the shell;

FIG. 11 shows a completed coupling;

FIG. 12 is an axonometric view of the suitcase, showing the telescopic arm used to drag the suitcase;

FIGS. from 13 to 15 show the handle applied to said telescopic arm;

FIGS. 16 and 16A show the telescopic arm applied to the frame of the suitcase;

FIG. 17 shows the same luggage to which different shells are applied;

FIG. 18 shows in an axonometric view the solution related to a shoulder backpack;

FIGS. from 19 to 21 show the solution of a quick coupling for the shell of said backpack, solution that may be used also for the suitcase.

DESCRIPTION OF SOME PREFERRED EMBODIMENTS

Figure 1:
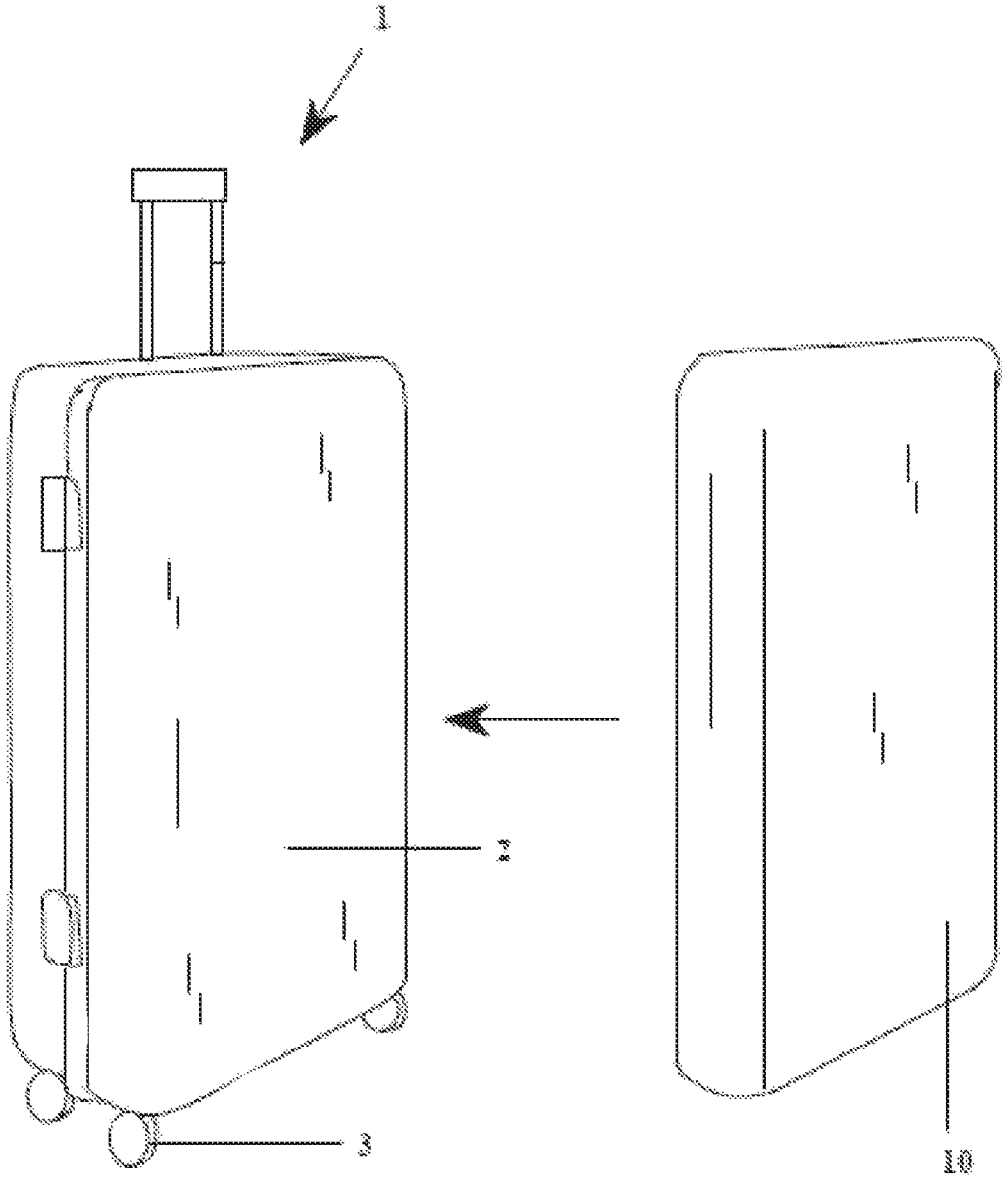
FIG. 1 shows schematically a suitcase to which a semi-shell 10 is applied in movable manner, once removed the original shell 2.

FIG. 1 shows the axonometric view of a rigid suitcase according to the present invention.

It can comprise an extractable/retractable handle, very well known in the background art in itself, by which the suitcase can be easily dragged.

Moreover, the suitcase can be easily equipped with wheels 3 in such a manner that it can be easily dragged by the user by the handle.

Obviously, the wheels 3 are in themselves very well known in the background art and they are not a specific object of the present invention.

Going further with the description of the invention, the suitcase is provided with a frame to which external shells can be applied in an interchangeable manner forming the body of the suitcase in its entirety (generally two shells) and such shells define the containment volume of the suitcase itself.

For example, FIG. 1 shows generically the shell 2, which is movable and interchangeable with a new shell 10. The same applies obviously to the counterposed shell.

Figure 2:
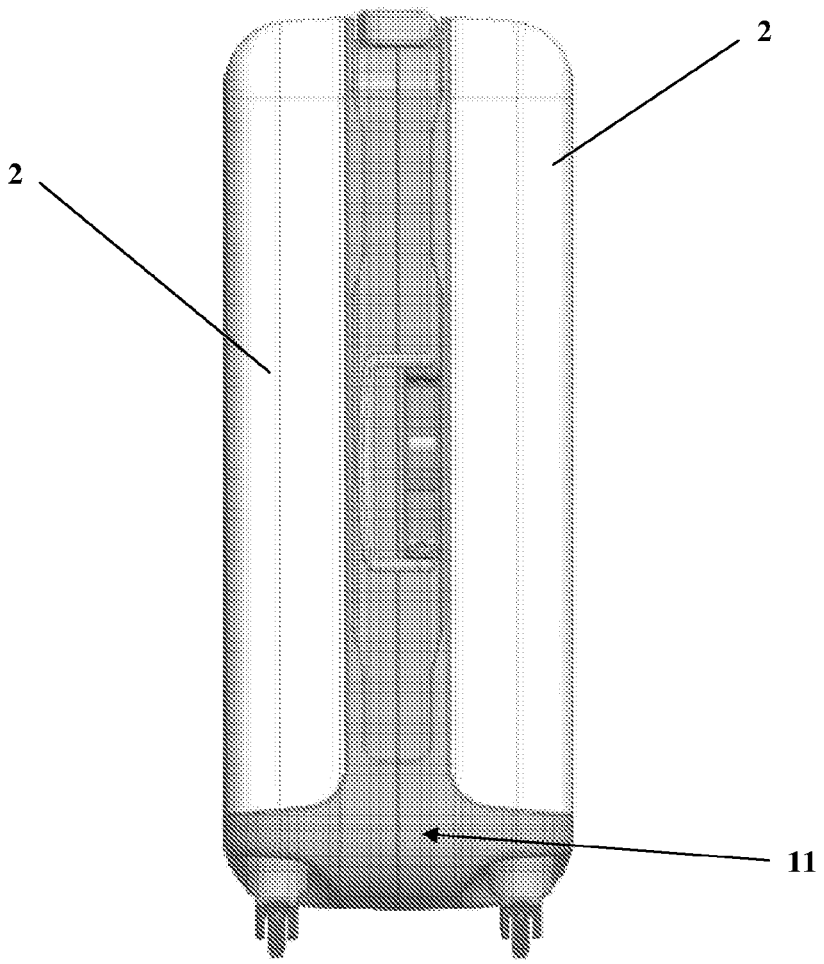
FIG. 2 shows in lateral view a suitcase according to the invention.

FIG. 2 shows a lateral view of the suitcase and underlines better a structure of the frame 11, wherein the left and right shells 2 are connected in interchangeable manner.

Both shells can be removed and changed with other compatible shells if necessary, for example of different colors or materials and different shapes.

The frame, as per the background art, is necessary for the overall support for fixing the wheels, the handles, the closing of the suitcase itself which can be opened into two halves and obviously is necessary for supporting the fixing of the body, in this case with a movable or whatever interchangeable fastening.

In this manner, if for example the shell 2 results damaged (only one or both), it is possible to change it, thus making the suitcase practically new and functional.

Moreover, it is possible to change easily the design of the suitcase, by choosing shells made of different colors/materials or even forms, thus making the suitcase always new.

Figure 3:
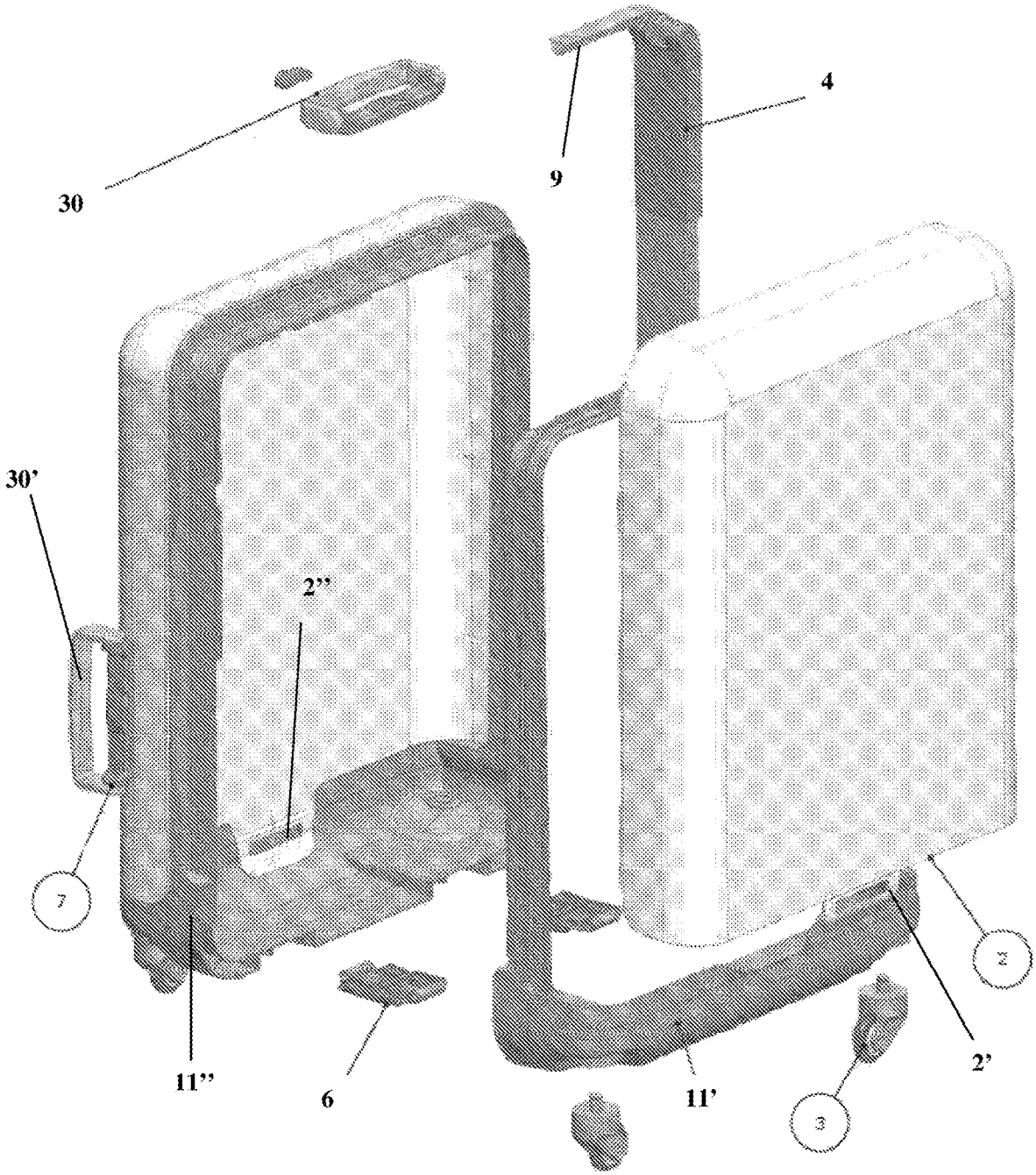
FIG. 3 shows an exploded view drawing of the suitcase, according to the present invention.

The exploded view drawing of FIG. 3 shows structurally in details such solution.

Number 30 and 30' indicate two common handles fixed on the two sides of the suitcase, in order to allow the user to lift the suitcase in two different ways.

The handles are rotatable in respect with an anchoring body to which are fixed rotationally, for example the component 7 in FIG. 3.

Such handles are well known in themselves in the background art and they will not be examined further.

Going further with the structural description of the invention, always referring to FIG. 3, a shell 2 is shown detached from the frame to be clearer. Such shell, as well the counterposed one, is connected to the frame in such a manner that it can be detached from the frame and be reapplied, or can be changed with another equivalent one.

Therefore, according to the invention, the two traditional shells connecting to the frame of a traditional suitcase are now fully removable and replaceable by equivalent ones.

The frame is formed by a sort of rectangular framework 11 which obviously traces the outside form of the luggage and to which the shell applies more or less as in the background art but it has the characteristic to allow the movable coupling with said shells.

In particular, the frame is divided into two preferably symmetric coupling parts (11', 11"). Each part of the frame forms such framework (11', 11') on which the shell is fixed. The framework, according to the invention, forms a side guide in respect to which the edge of the shell is made to move from top to bottom.

The sequence of FIGS. from 6 to 11 shows very well such solution both structurally and functionally.

Figure 6:
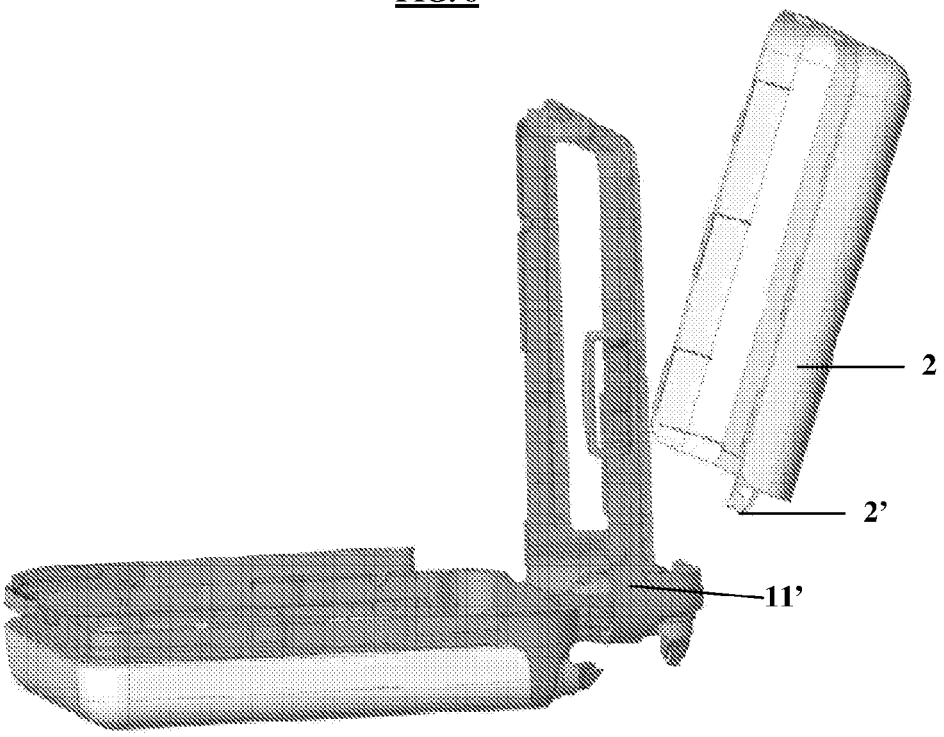
FIG. 6, 7, 8 show as an example a phase of inserting a shell.

In particular, as shown in FIG. 6, the shell has at its basis an appendix, for example a flap 2', in flexible material (for example it can be also the same material of the shell but with such a thickness that it results flexible and has a spring back).

Said appendix, while inserting and sliding the shell with respect to the guide formed by the frame 11, climbs over a pivot 2" built into the frame and results insertable into the receiving hole, obtained in said appendix.

Figure 7:
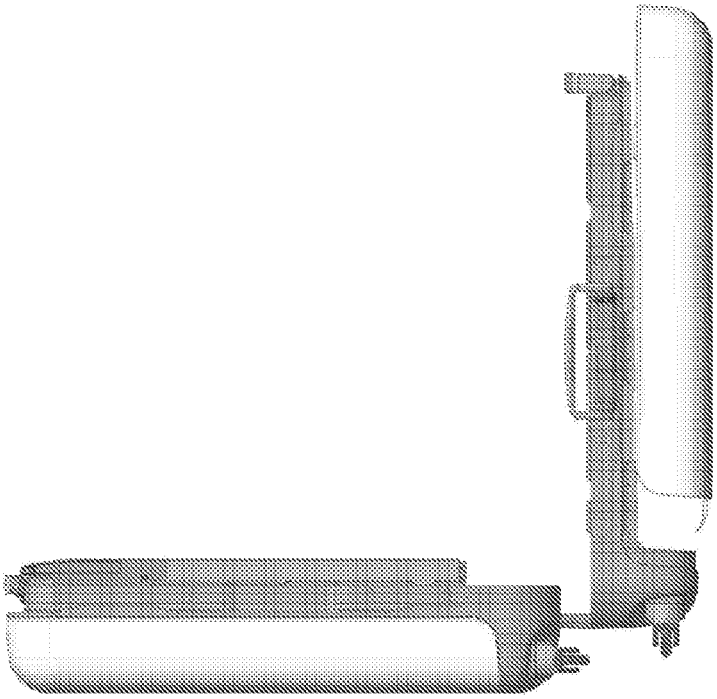
Figure 8:
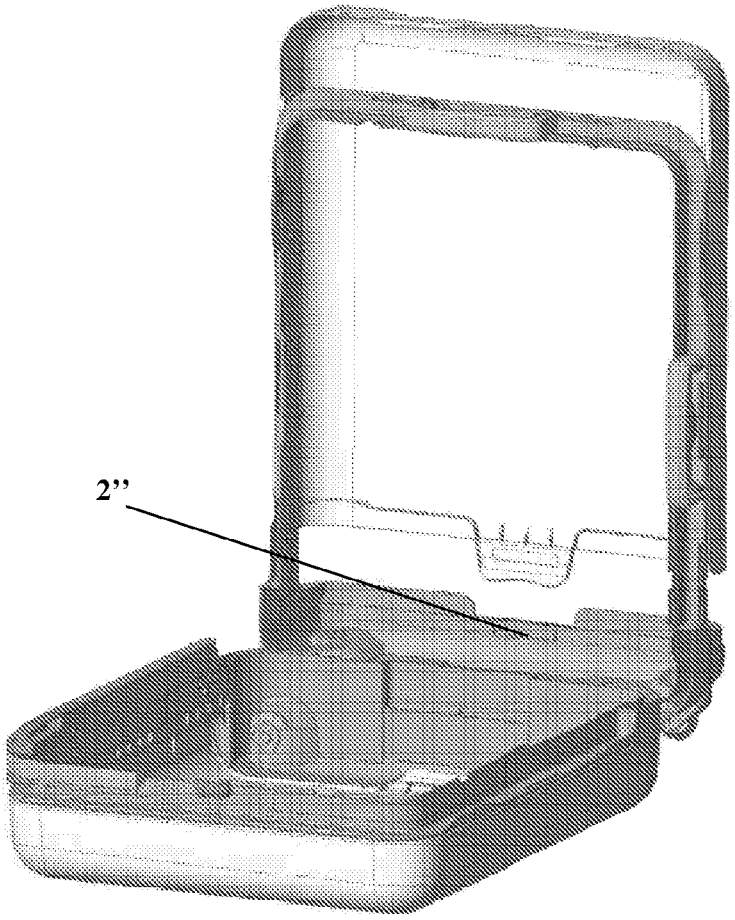

FIGS. 7 and 8 show in axonometric view an inserting phase.

The sections in FIGS. 9 and 10 show such inserting phase wherein the flap climbs over the pivot in such a manner that the hole obtained in the flap can insert itself inside the pivot (see FIG. 10).

For the detachment the user can act on the flap manually by flexing it in order to cause the discharge of the pivot from the hole and thus proceeding with the removal of the shell.

Such solution is used for both shells on the two halves of the frame.

Obviously other locking systems of the shell may be used.

For example, a lock of the appendix in a seat via mechanical interference.

Obviously, the appendix-pivot solution guarantees a perfect gripping of the shell, which is removed only if the user acts on purpose on the flap. Therefore, there is no risk of accidental detachments and such solution results easy to realize.

As shown in FIG. 3 as well, the component 6 represents a hinge which connects rotatably the two symmetrical halves of the frame each other (11', 11').

Figure 4:
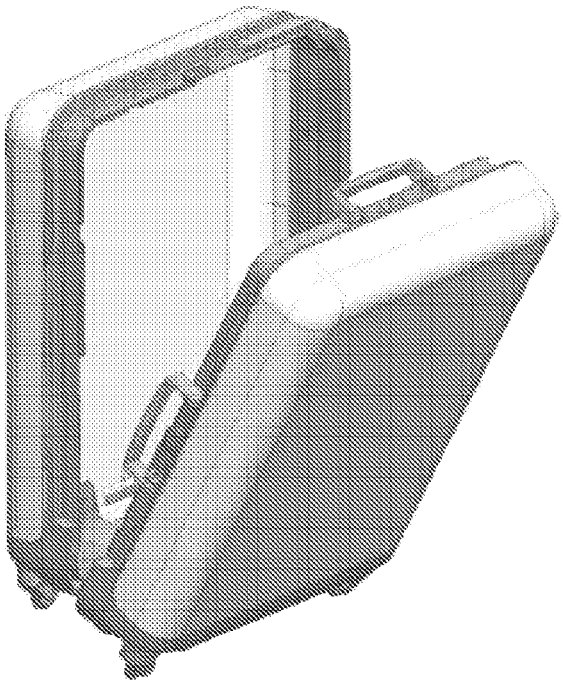
FIG. 4 and FIG. 5 show in axonometric view the suitcase in an opened configuration and in a closed configuration.

In this way, as shown also in FIG. 4, a part results openable in respect with the other so that the two halves of the luggage result opened as a book and are then closable again.

Contrary to the background art, the hinges are at the basis of the suitcase and not on its side, exactly at the basis where the wheels are placed and so the way of opening is that of FIG. 4 in which the couples of wheels are one towards the other in opened position.

Such way of opening is therefore an alternative to the common solution.

Preferably, at least two hinges 6 placed side by side are provided.

Going further with the structural description of the invention, referring to FIG. 3 as well, the component 9 shows the dragging handle which is connected to the extractable/retractable arm 4 (that is a telescopic arm).

Although extractable/retractable arms are usable as in the background art, as for example the arm shown in FIG. 1, such arm 4, contrary to the background art is placed laterally and moves along a seat obtained along the side of the frame 11.

FIG. 12 shows the arm in the extracted configuration and moving slidingly in respect with a sort of track obtained by the external perimeter of the frame.

Figure 5:
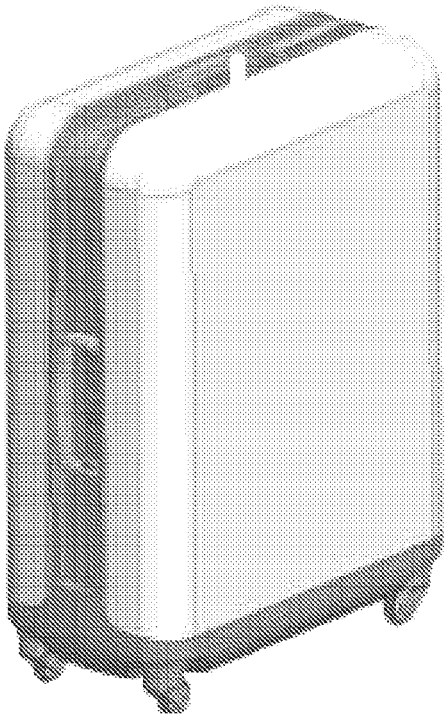

The two halves of the frame (11', 11') form said sliding duct along their perimeter and said handle 9 disappears inside the area delimited by such two halves of the frame, as shown in FIG. 5, moving substantially to the same level of the body when fully retracted. In this manner, it is possible to have a remarkable saving of encumbrance, as the handle 9 and the arm itself to which the handle is connected are de facto hidden inside the frame itself, without any obstruction.

FIG. 16 shows the compartment of the telescopic arm in respect with one half of the frame and in respect of which results sliding between an extracted and a retracted position.

FIG. 16A shows with number 40 the sliding track.

Obviously, well known locks as per the background art can be used to limit the extraction stroke of the arm.

The handle 9, as shown in the sequence of FIGS. from 13 to 15, can be hinged to a point in such a manner that it can rotate depending on the needs in convenient positions for the user. It has preferably a L shape.

FIG. 17 shows an explaining example wherein, according to the invention, the external shell is substituted on said luggage with different models.

In this example, only for clarity and not in a restrictive way, there is shown a suitcase with an extractable handle of the traditional type.

The above-mentioned description is valid for every container and indeed the same solution can be applied also to a backpack.

More in detail, FIG. 18 shows an exploded view drawing of a backpack according to the present invention.

Such backpack comprises a frame 102, in the form of an annular element as well, which, like the suitcase, traces the outline form of the backpack.

Such annular element is necessary to hold and lock, in removable manner, the rigid or semi-rigid shell of the backpack, like the solution of the suitcase.

For this purpose, FIG. 18 shows with the number 101 the shell which inserts itself inside said annular frame, until the border of the shell contacts the annular frame in its whole lengths. Contrary to the solution of the suitcase, in this case the insertion occurs by pushing the shell against the frame and not by sliding, in such a manner that the mobile pivot 105, fixed to the frame, results insertable inside a receiving hole 106 of the shell.

Such solution is explained more in detail on the enlarged view of FIGS. from 19 to 21.

Figure 19:
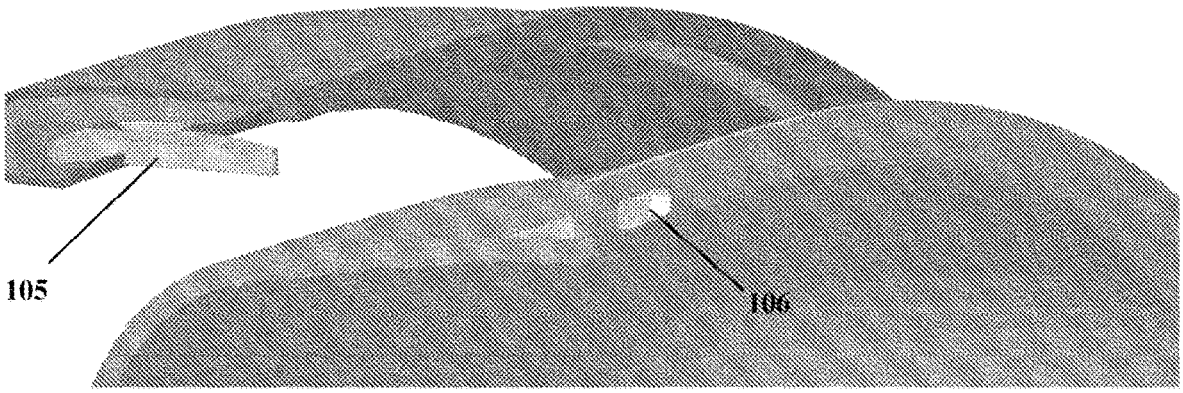
Figure 20:
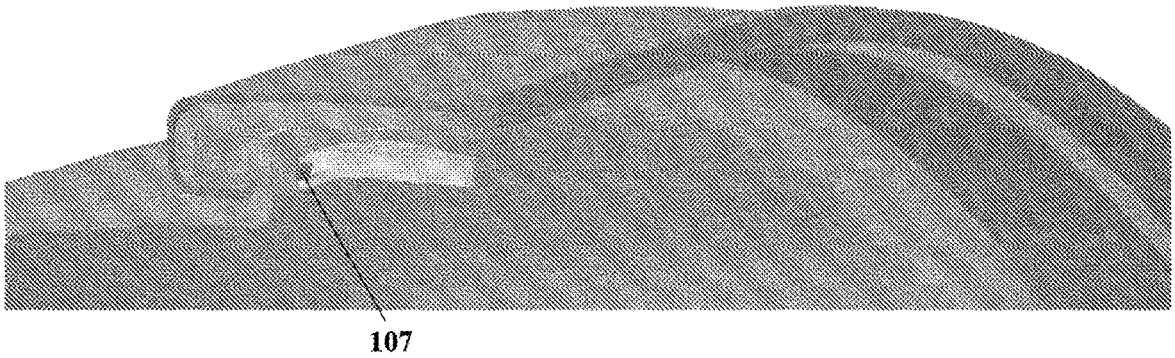

FIG. 19 shows the pivot 105 when the shell has to be coupled with the annular element which forms the frame. FIG. 20 shows the occurred coupling. The pivot is shaped in form of a triangle or arrow and then has a sloping side which allows its lateral movement while the shell is moving and so during the insertion of the pivot inside the hole, until, while fully inserted, the pivot springs another time moving to the opposite side and locking itself. In fact, there is provided a spring 107 maintaining such pivot in the position of FIG. 19, that is fully moved to the right. While the progressive insertion inside the hole 106, thanks to the sloping side, the pivot moves to the left, once beyond the hole, thus returning to the position of FIG. 19, due to the action of the spring (or another elastic element in general) and so locking itself definitively.

The user has to move manually the pivot on the left in order to remove the shell, thus overcoming the force of the spring (or of the elastic element in general).

Figure 21:
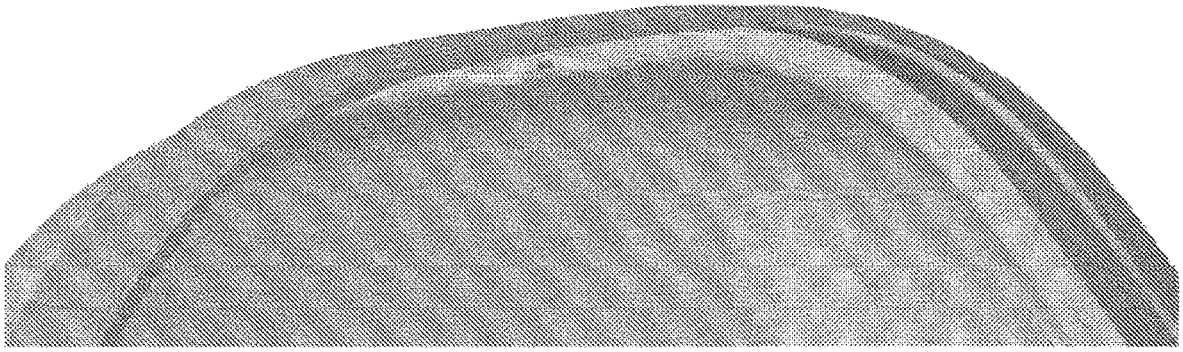

FIG. 21 shows a solution with two symmetric pivots and two receiving holes.

On request, such solution could be also adaptable to the suitcase, preferably to smaller sizes suitcases.

In all described configurations, for the suitcase, the backpack, or even other containers in general, the shell or semi-shell is preferably made of a rigid material, such as for example plastic, carbon-fibers, PVC, polypropylene, ABS, polycarbonate and similar ones and so it can be cast in a mold or shaped.

Furthermore, such size of the shell delimits generally a more or less symmetric half of an overall containment volume (defined for example by the two shells of the suitcase or the shell of the backpack).

Furthermore, such shell might also be realized with semi-rigid materials, such as for example rubber. So it would result both very flexible and impact absorbing.

Instead a textile shell is excluded, because it is not capable of protecting from impacts.

In the present invention, rigid or semi-rigid materials comprise molding materials, for example in a mold to obtain the shape of the half suitcase (or the full luggage) that will cover the suitcase and so to maintain the shape of the half luggage (or full luggage) and covering also without being applied to the suitcase.

In that sense, the textile is not to be considered a rigid or semi-rigid material.

However, in order to change further the design of the luggage, it is possible to provide a shell in the above mentioned rigid or semi-rigid materials but covered externally with textile, for example denim textile. Such solution is valid for all described configurations.

Obviously, the sale of suitcases arranged in such a manner that they can couple with a semi-shell, and also the separate sale of one or more replacement semi-shells for such suitcases can be provided, in order to inter-change them if necessary.

The entire preceding description is valid for any personal container for the transport of objects/clothing/accessories/books.

Therefore, in that sense, the invention is not only limited to the mere suitcase (meaning every type of suitcase including Trolleys), but also to bags, backpacks, pouches and so containers for personal use and transportable by the user.

The invention claimed is:

1. A container for transport of objects, clothing, accessories, and books, comprising: a frame having a hinged side; at least one shell connected to the frame and delimiting at least partly an inner containment volume, wherein the at least one shell has a top edge, side edges, and a base edge that extends perpendicularly to the side edges, and wherein the at least one shell is connected to the frame in an interchangeable way; and quick connection means that connect the at least one shell to the frame in the interchangeable way, wherein the frame is annularly shaped and forms side guides for a longitudinal sliding the side edges along the side guides, and wherein the side edges slide along the side guides until the top and base edges reach respective facing edges of the frame, and the base edge engages the respective facing edge of the frame with the quick connection means, causing the at least one shell to become engaged to the frame; wherein the quick connection means comprise an appendix of the at least one shell having a receiving hole defined therein and a pivot belonging to the frame, the pivot being insertable into the receiving hole.

2. The container, as per claim 1, wherein the appendix is flexible and has a spring back.

3. The container, as per claim 1, wherein the appendix extends from the base edge of the at least one shell, the base edge not sliding along any guides of the frame.

4. The container, as per claim 1, wherein the quick connection means comprise at least one pivot having a triangular or arrow shape configured to be inserted inside a receiving hole belonging to the at least one shell.

5. The container, as per claim 4, wherein the frame is annularly shaped and the at least one shell is insertable inside the annular frame by pushing the at least one shell until the pivot is inserted inside the receiving hole.

6. The container, as per claim 1, wherein the container is configured to be:

a suitcase; or a backpack.

7. The container, as per claim 6, wherein the container is configured to be a suitcase, further comprising an extractable/retractable arm slidingly positioned in relation to the frame along one side of the suitcase and arranged to become hidden inside the frame when the arm is in retracted position.

8. The container, as per claim 7, wherein the arm is equipped with a handle hinged on a point at an end of the arm.

9. The container, as per claim 6, wherein the container is a suitcase formed of two halves hinged to each other at a base of the suitcase, the two halves being hinged to open or close in the manner of a book.

10. The container, as per claim 1, wherein the at least one shell is made of a rigid or semi-rigid material.

11. The container, as per claim 1, wherein the at least one shell is made from a material selected from the group consisting of plastic, carbon fibers, PVC, polypropylene, ABS, polycarbonate, and rubber.

12. The container, as per claim 1, wherein the at least one shell is made from a material workable in a casting mold.

13. The container, as per claim 1, wherein the container is a suitcase, and the at least one shell is two removable symmetrical shells.

* * * * *